United States Patent [19]

Ishii et al.

[11] Patent Number: 4,783,587

[45] Date of Patent: Nov. 8, 1988

[54] SELF-REGULATING HEATING ARTICLE HAVING ELECTRODES DIRECTLY CONNECTED TO A PTC LAYER

[75] Inventors: Kazunori Ishii; Seishi Terakado, both of Nara; Yasutomo Funakoshi; Tadashi Sakairi, both of Osaka, all of Japan

[73] Assignee: Matsushita Electric Industrial Co., Ltd., Osaka, Japan

[21] Appl. No.: 809,966

[22] Filed: Dec. 17, 1985

[30] Foreign Application Priority Data

| | | | |
|---|---|---|---|
| Dec. 18, 1984 | [JP] | Japan | 59-266640 |
| Dec. 18, 1984 | [JP] | Japan | 59-266641 |
| Dec. 18, 1984 | [JP] | Japan | 59-266647 |
| Dec. 18, 1984 | [JP] | Japan | 59-266649 |
| Dec. 18, 1984 | [JP] | Japan | 59-266664 |
| Dec. 18, 1984 | [JP] | Japan | 59-266665 |
| Dec. 18, 1984 | [JP] | Japan | 59-266666 |
| Dec. 18, 1984 | [JP] | Japan | 59-266668 |
| Dec. 18, 1984 | [JP] | Japan | 59-266669 |
| Oct. 18, 1985 | [JP] | Japan | 60-233618 |

[51] Int. Cl.[4] ..... H05B 3/10

[52] U.S. Cl. ..... 219/548; 219/549; 219/553

[58] Field of Search ..... 219/548, 549, 552, 553, 219/528; 338/225 D, 225 R, 212

[56] References Cited

U.S. PATENT DOCUMENTS

| | | | |
|---|---|---|---|
| 3,221,145 | 11/1965 | Hager et al. | 219/549 |
| 3,243,753 | 3/1966 | Kohler | 338/31 |
| 3,397,302 | 8/1968 | Hosford | 219/528 |
| 3,410,984 | 11/1968 | Sandford et al. | 219/212 |
| 3,564,199 | 2/1971 | Blaha | 219/311 |
| 4,177,376 | 12/1979 | Horsma et al. | 219/553 |
| 4,317,027 | 2/1982 | Middleman et al. | 219/548 X |
| 4,517,449 | 5/1985 | Chazan et al. | 219/549 |

FOREIGN PATENT DOCUMENTS

| | | |
|---|---|---|
| 325176 | 10/1975 | Austria . |
| 0019376 | 11/1980 | European Pat. Off. . |
| 0022611 | 1/1981 | European Pat. Off. . |
| 0026457 | 4/1981 | European Pat. Off. . |
| 3042420 | 6/1982 | Fed. Rep. of Germany . |
| 3311803 | 10/1984 | Fed. Rep. of Germany . |
| 2165943 | 8/1973 | France . |

*Primary Examiner*—E. A. Goldberg
*Assistant Examiner*—C. M. Sigda
*Attorney, Agent, or Firm*—Pollock, VandeSande & Priddy

[57] ABSTRACT

A self-regulating heating article comprises a first elongate layer formed by a crystalline polymeric composition of high crystallinity and conductive particles dispersed in the polymeric composition to exhibit a positive temperature coefficient of resistance. A pair of elongate electrodes, which are adapted for connection to a mains supply, are secured one on each surface of the first layer to develop a potential in the direction of thickness of the first layer. The electrodes are arranged so that a creeping distance which is greater than the thickness of the first layer is established between the electrodes along peripheral edges thereof. The creeping distance prevents insulation breakdown and ensures safe, high wattage operation at mains voltages.

3 Claims, 8 Drawing Sheets

SELF-REGULATING HEATING ARTICLE HAVING ELECTRODES DIRECTLY CONNECTED TO A PTC LAYER

BACKGROUND OF THE INVENTION

The present invention relates to a layered heating article formed of a material exhibiting a positive temperature coefficient of resistance.

The present invention relates generally to heating elements, and more particularly to a self-regulating heating article which utilizes a material exhibiting positive temperature coefficient (PTC) of resistance.

The distinguishing characteristic of PC materials is that on reaching a certain temperature (switching temperature), a sharp rise in resistance occurs and the heating article utilizing such materials switches off.

There exists a need for flexible strip heaters with high power output densities and/or higher operating temperatures. One approach to electrical heating appliances involves forming a PTC material into a two-dimensional sheet and attaching to it a pair of strip electrodes, one at each end of the PTC sheet. The actual wattage delivered by such prior art heater is far less than that which would be expected because the heat is produced in a very thin band between the strip electrodes. Such a phenomenon, which is termed "hotline" by Horsma et al in U.S. Pat. No. 4,177,376, results in an inadequate heating performance and renders the heating appliance useless where high wattage outputs and/or temperatures above 100° C. are desired. The aforesaid United States patent avoids this hotline problem by interposing a constant wattage (CW) layer between a PTC layer and an electrode.

It is still desired that the thermal resistance between electrodes be as small as possible for more efficient operation. Improvement in the manufacture of PTC heating appliances is further desired for cost reduction.

SUMMARY OF THE INVENTION

It is therefore a primary object of the present invention to provide an efficient high-wattage level PTC heating article.

This object is attained by a self-regulating heating article which comprises a first elongate layer comprising a crystalline polymeric composition of high crystallinity and conductive particles dispersed in the polymeric composition to exhibit a positive temperature coefficient of resistance. A pair of elongate electrodes, which are adapted for connection to a power supply, is secured one on each surface of the first layer to develop a potential in the direction of thickness of the first layer. The electrodes are arranged so that a creeping distance which is greater than the thickness of the first layer is established between the electrodes along peripheral edges thereof. The creeping distance prevents insulation breakdown and ensures safe, high wattage operation at mains supply voltages.

Because of the simplified laminated structure, a substantial improvement in productivity can be achieved.

BRIEF DESCRIPTION OF THE DRAWINGS

Further features and advantages of the present invention will be described with reference to the accompanying drawings, in which.

DETAILED DESCRIPTION

Figure 1:
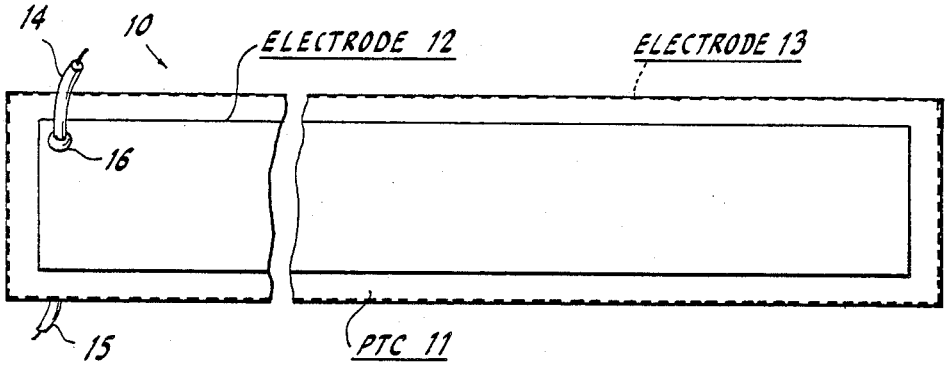
FIG. 1 is a plan view of a self-regulating heating article according to a first embodiment of the invention.
Figure 2:
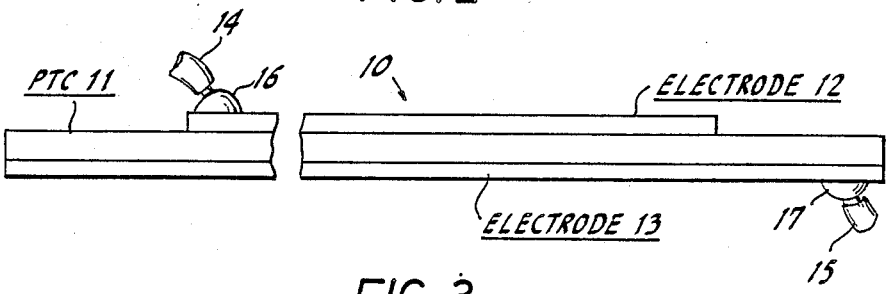
FIG. 2 is an end view of the first embodiment.

Referring now to FIGS. 1 and 2, there is shown a layered self-regulating heating article 10 according to an embodiment of the present invention in the form of a 300-mm long and 10-mm wide strip. Heating strip 10 has such a thickness that it can flex to adopt the shape of an article to be heated. As will be later described, heating strip 10 may be sandwiched between metal plates for space heating.

Heating strip 10 comprises a resistance layer 11 of material having a positive temperature coefficient (PTC) of resistance. PTC resistance layer 11 is sandwiched between an upper conductive layer or electrode 12 and a lower conductive layer or electrode 13 which is indicated by a dotted line in FIG. 1. Electrodes 12 and 13 are adapted for connection to power supply, which is typically in the range between 100 and 200 volts, through lead wires 14, 15 connected by soldered joints as at 16 and 17, respectively. Upper layer 12 is offset inwardly by 2.5 mm along all the edges thereof from the peripheral edges of the PTC layer 11 to provide a sufficient "creeping distance" of 2.8 mm between the electrodes 12 and 13 to ensure electrical insulation. The creeping distance is the shortest distance along which current would seek a low impedance path which might exist between the electrodes when potential is applied thereacross. Experiments showed that resistance layer 11 having a thickness smaller than 3 mm, preferably 1 mm or less, and a thermal resistance of 0.02 $m^2h°C./Kcal$, gives high wattage levels with uniform heat distributions. In the illustrated embodiment the thickness of PTC resistance layer 11 is 0.3 mm.

Resistance layer 11 is formed of a resin of high crystallinity capable of withstanding high potentials and 30 weight-percent of carbon black particles having a substantially spherical shape with an average size of more than 0.05 micrometer, typically 0.1 micrometer, uniformly dispersed in substantial contact with one another. The carbon black particles form conductive networks through the resin matrix to establish an initially low resistivity at lower temperatures. At about the crystalline melt point, the resin's matrix rapidly expands, causing a breakup of many of the conductive networks due to the difference in thermal expansion between the two materials, which in turn results in a sharp increase in the resistance of the composition to a resistivity which is $10^4$ to $10^6$ times higher than the room temperature value.

The resin suitable for the present invention has a high degree of crystallization, typically 20 percent or more according to X-ray analysis. Suitable materials for the resin include polyolefins such as ethylene-vinyl acetate copolymers, ethylene-ethyl acrylate copolymers, ionomer polyethylene, polypropylene and the like, and crystalline resins such as polyamides, halogenated vinylidene resins, polyesters and the like. Crosslinking agent or filler may be added to avoid deformation of the PTC element and to keep it from exhibiting a negative temperature characteristic. Coupling agent may also be added or graft polymerization may be provided to enhance the bond between the particulate carbon and resin matrix. With such additional agents or process, the PTC element can be made to exhibit a sharper increase in resistivity which is $10^9$ times higher than the room temperature resistivity. When an AC potential of 100 volts was applied, the heating article 10 showed an initial wattage of 6 watts/cm$^2$ and levelled off to a steady value of 2 watts/cm$^2$. A temperature gradient of lower than 3° C. was observed between the electrodes 12 and 13, and a temperature of as high as 100° C. was obtained on both sides of the strip 10. The fact that the temperature gradient is 3° C. indicates that no "hotline" problem takes place. For testing purposes, the heating article was impressed with AC potentials of 200 volts, 250 volts, 300 volts and finally 500 volts, in succession, but abnormal leakage current was not observed.

Resistance layer 11 is made by a long strip of the PTC material mentioned above using an extrusion molding process and continuously cemented to long conductive strips on opposite sides by thermosetting or using a conductive adhesive agent to provide an elongate metal-backed structure. The latter is then cut into segments of desired length, typically 300 mm intervals, as mentioned above.

Figure 3:
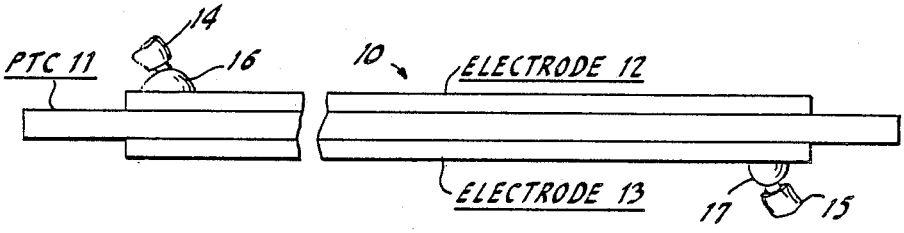
FIGS. 3 and 4 are views of modified embodiments of the invention.
Figure 4:
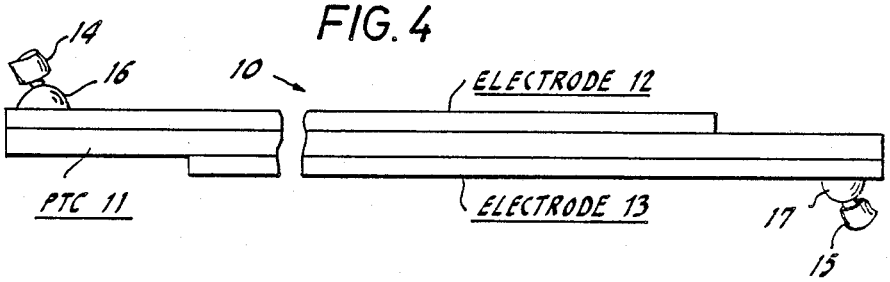

Modifications are possible to provide the necessary creeping distance as shown in FIGS. 3 and 4.

In FIG. 3, the upper and lower electrodes 12, 13 are offset by 1.5 mm on all their edges from the peripheral edges of the 0.3-mm thick PTC layer 11. The creeping distance of this embodiment is 3.3 mm. It is obvious that the electrodes are not necessarily centered with respect to the PTC strip 11 insofar as the creeping distance is ensured.

In FIG. 4, the upper and lower electrodes 12, 13 are offset by 2.5 mm from the right and left longitudinal edges of the 0.5-mm thick PTC layer 11, respectively, to give a creeping distance of 2.8 mm. This embodiment is preferred in favor of the previous embodiments in that the longitudinal edges of the PTC strip 11 are reenforced by the backing conductive layer; and conductive strips of the same width can be used for the electrodes.

Figure 5:
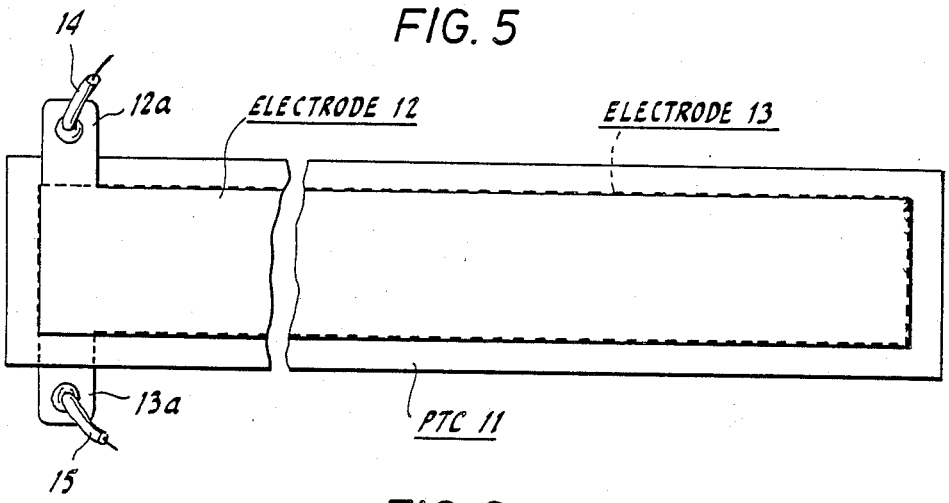
FIGS. 5 to 7 are plan views of further modifications of the invention.

For manufacturing purposes, it is advantageous to perform soldering on the same side of the article 10. FIG. 5 is an illustration of an embodiment suitable for this purpose. Electrodes 12 and 13 are provided respectively with lateral projections 12*a* and 13*a* extending laterally in opposite directions to each other to present a surface sufficient for the soldering operation and to permit the soldering machine to be accessed thereto in the same direction. Since soldering material tends to be heated by a current passing through it and since the lateral projections 12*a* and 13*a* are not in thermal contact with the PTC layer 11, the latter is protected from excessive heat developed in the soldered contact portions.

The problem associated with soldering can also be avoided by arrangements shown in FIGS. 6 to 10.

Figure 6:
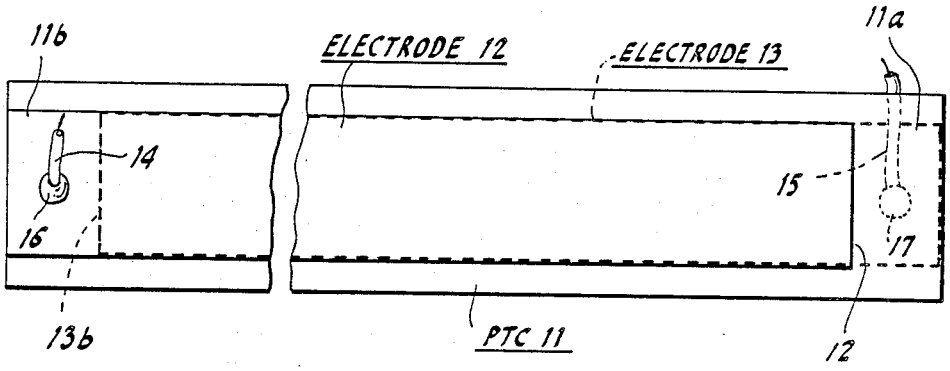

In FIG. 6, the upper electrode 12 is offset at its right-end edge 12*b* and the lower electrode 13 is offset at its left-end edge 13*b* to expose the PTC layer 11 at end portions 11*a* and 11*b*. Lead wire 14 is soldered on a portion of the upper electrode 12 which is overlying the exposed portion 11*b* of the PTC layer 11 and lead wire 15 is soldered on a portion of the lower electrode 13 which is underlying the exposed portion 11*a* of the PTC layer 11. If the soldered joints 16 and 17 are heated excessively and the desired characteristics of the PTC layer are destroyed at portions 11*a* and 11*b* to the detriment of their insulation, such insulation failure will be confined to localized areas and shorting between electrodes 12 and 13 through the failed part of the PTC layer can be avoided due to the absence of an adjacent counterelectrode.

Figure 7:
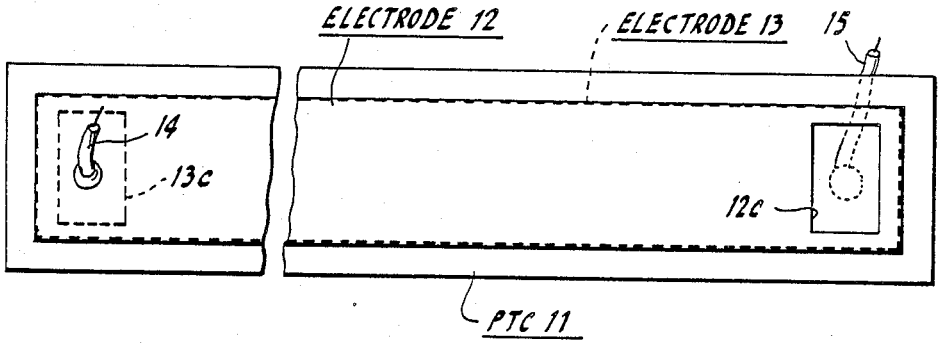

Alternatively, in FIG. 7, the upper and lower electrodes 12, 13 are formed with windows 12*c* and 13*c*, respectively, in positions adjacent the left- and right-end edges of the heating strip 10. Lead wire 14 is soldered in the portion of the electrode 12, below which the window 13*c* is formed and lead wire 15 is soldered in the portion of the electrode 13 above which the window 12*c* is provided.

Figure 8:
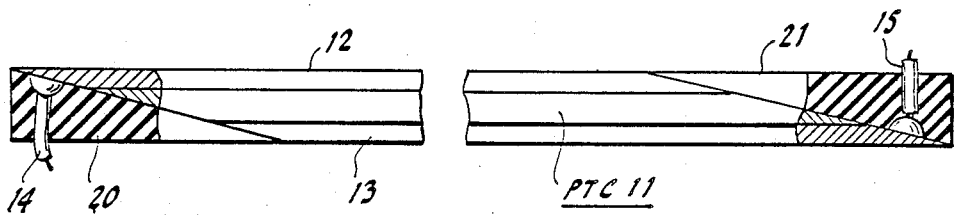
FIGS. 8 to 10 are side views of still further modifications of the invention.
Figure 9:
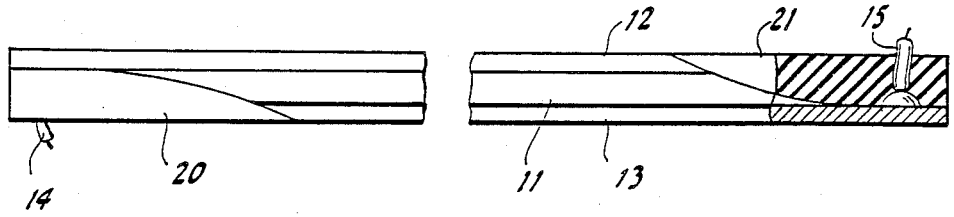
Figure 10:
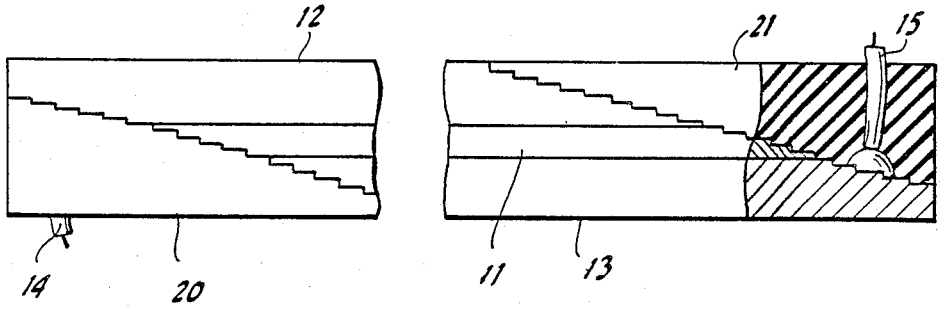

The individual heating segments have sufficient creeping distance with respect to their longitudinal edges. However, if the cut angle is perpendicular to the surface of the workpiece, the creeping distance is not sufficient with respect to the edges at each end thereof. FIGS. 8 to 10 illustrate embodiments having bevelled edges at opposite ends to provide the necessary creeping distance in efficient manner.

In FIG. 8, each end of the strip 10 having a 0.5-mm thick PTC layer 11 has a bevelled edge inclined at an angle, typically at 11 degrees, to the length thereof to provide a creeping distance of 2.6 mm, for example. Lead wires 14 and 15 are soldered to the bevelled surfaces of electrodes 12 and 13, respectively, and insulating thermosetting material is molded on the bevelled edges as shown at 20 and 21 to conceal the soldered portions. The bevelled surface can be formed by tilting the cut angle when the long composite strip is cut into the individual segments. The creeping distance can be lengthened by forming curved surfaces as shown at FIG. 9 to increase the creeping distances. Instead of the curved surfaces, each end of the segmented strip may be formed into the shape of a staircase using a milling machine as shown in FIG. 10. The creeping distance is, of course, determined by the steps formed in the PTC layer 11.

Embodiments shown in FIGS. 11 to 15 provide the necessary creeping distance at opposite ends of the segmented heating strip with the cut angle being maintained at 90 degrees to the length of the strip.

Figure 11:
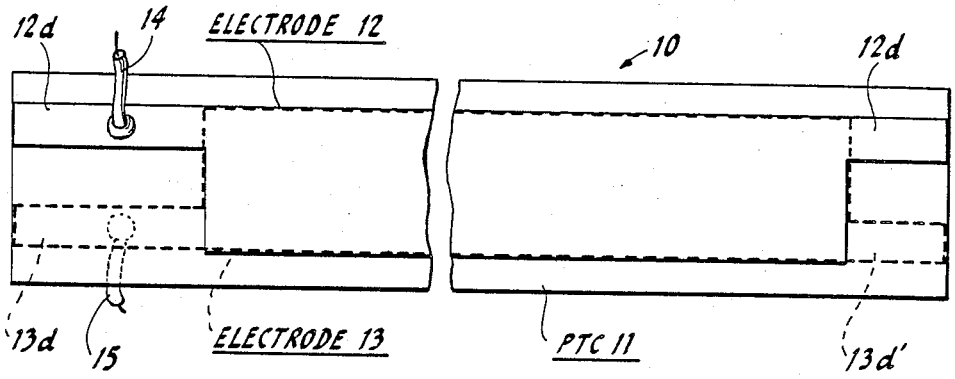
FIG. 11 is a plan view of a modified embodiment useful for efficient manufacture.
Figure 12:
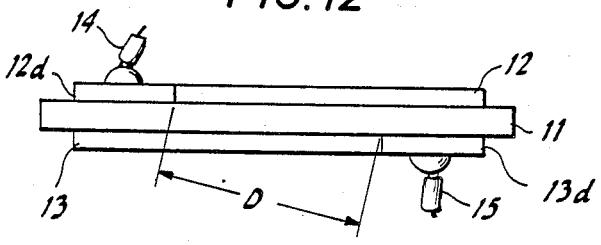
FIG. 12 is an end view of this modification.
Figure 13:
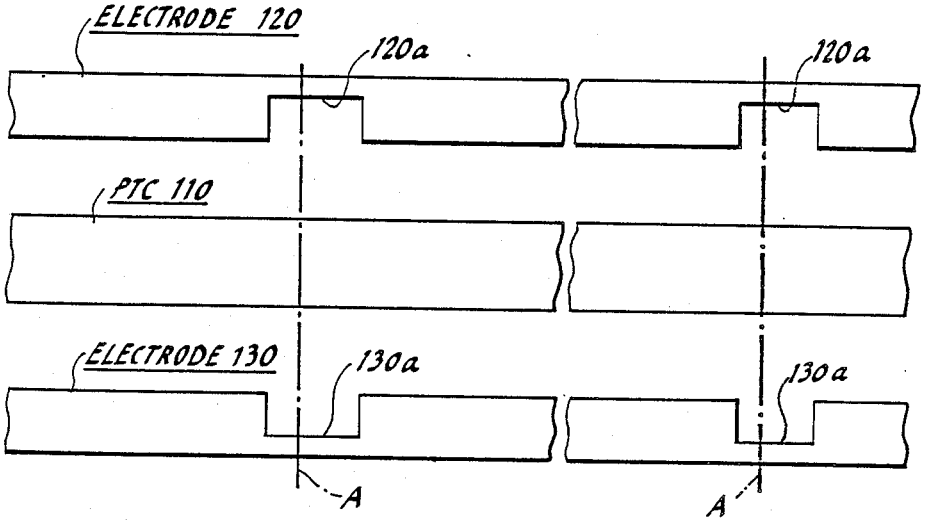
FIG. 13 is an illustration useful for describing the method by which the heating articles of FIG. 11 are manufactured.

Electrode 12 of the FIG. 11 embodiment has a narrow end portion 12*d* at the left end and narrow end portion 12*d'* at the right end which is one-half the length of the portion 12*d*. Similarly, electrode 13 has a narrow end portion 13*d* at the left end and a narrow end portion 13*d'* at the right end, the portions 13*d* and 13*d'* being displaced transversely from the end portions 12*b* and 12*d'*, respectively. Lead wires 14 and 15 are soldered to the longer end portions 12*d* and 13*d*, respectively. The creeping distance D at each end of the article 10 is measured between the end portions 12*d* and 13*d* as shown in FIG. 12. As shown in FIG. 13, the FIG. 11 embodiment is fabricated by preparing a long strip of conductor 120 having cutout portions 120*a* formed at longitudinal intervals and a second long strip of conductor 130 having similar cutout portions 130*a*. Conductors 120 and 130 are cemented on the opposite sides of a PTC strip 110 so that cutout portions 120*a* and 130*a* are aligned longitudinally with each other but not aligned transversely with each other. The layered structure is then cut at right angles thereto along chain-dot lines A which lie at one-third of the length of the cutouts.

Figure 14:
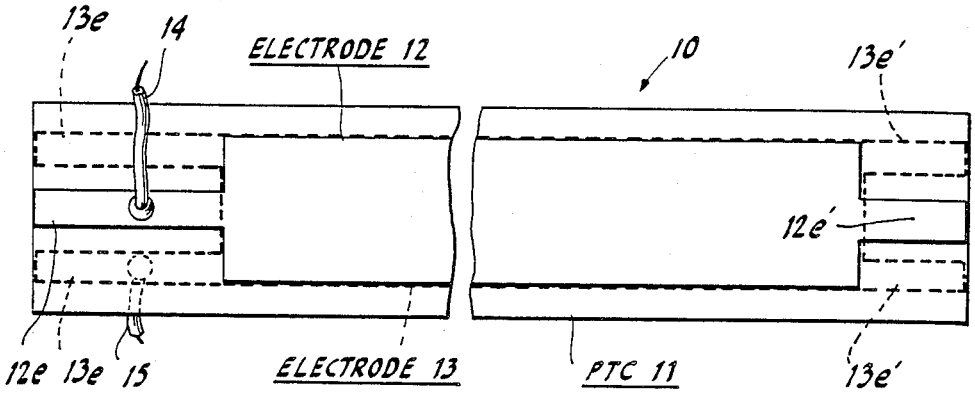
FIG. 14 is a plan view of an alternative form of the FIG. 11 embodiment.
Figure 15:
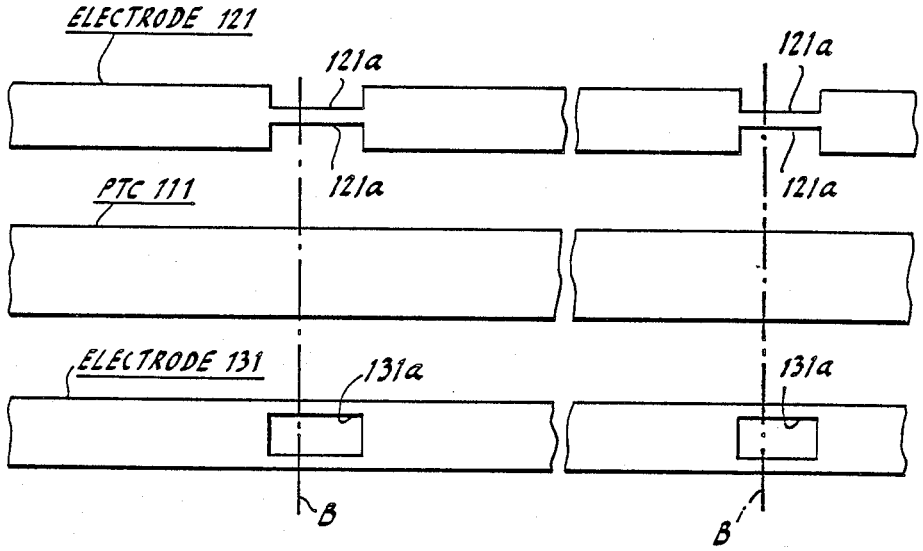
FIG. 15 is an illustration useful for describing the method by which the heating articles of FIG. 14 are manufactured.

Alternatively, the electrode 12 of the embodiment of FIG. 14 has a narrow end portion 12*e* at the left end and a narrow end portion 12*e'* at the right end, which is one-half the length of the end portion 12*e*. Electrode 13 has a pair of transversely spaced narrow end portions 13*e* at the left end and a pair of transversely spaced narrow end portions 13*e'* at the right end. End portions 12*e* and 12*e'* are not aligned with the end portions 13*e* and 13*e'* to provide the necessary creeping distance. The FIG. 14 embodiment is fabricated by preparing a long strip of conductor 121 as shown in FIG. 15 with a plurality of pairs of transversely spaced cutout portions 121*a* at longitudinal intervals and a long strip of conductor 131 having a plurality of rectangular cutouts 131*a* and cementing the conductors onto a PTC strip 111. The layered structure is cut into segments along lines B which lie at one-third of the length of the cutout 121*a*.

Because of the laterally displaced location of the narrow end portions, the embodiments of FIGS. 11 and 14 are also protected from insulation breakdown which might occur as a result of excessive heat generated by soldered joints in a manner identical to the embodiments of FIGS. 6 and 7.

Figure 16:
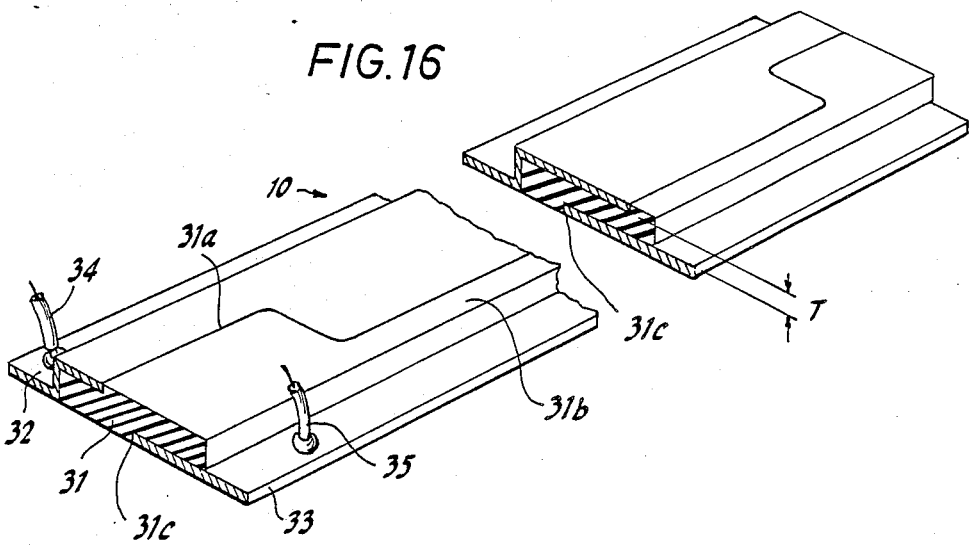
FIG. 16 is a perspective view of a modified form of the FIG. 11 embodiment with an illustration of a transverse cross-section.

FIG. 16 is a modification of the FIG. 11 embodiment. In this modification, heating article 10 is formed by a PTC layer 31 having a shallow recess 31*a* on the upper surface thereof with the boundary between it and the land portion 31*b* following a curve generally similar to the contour line of the electrode 12 of FIG. 11. Upper electrode 32 has a contour line identical to the contour line of the recess 31*a* and a stepped portion along the longitudinal straight edge. The upper portion of electrode 32 is cemented to the recess 31*a* of PTC layer 31 and the stepped portion to a longitudinal edge thereof, so that the upper surface of electrode 32 and the land portion 31*b* of PTC layer 31 are even with each other concealing the edge of electrode 32 in the recess and the flange portion of electrode 32 made flush with the lower surface of PTC layer 31. PTC layer 31 is further formed with a recess 31*c* on the lower surface thereof. Lower electrode 33 is cemented to the recess 31*c* presenting a flat surface with the PTC layer 31 so that a portion of the electrode 33 forms a flange on the opposite side to the flange of upper electrode 32. Lead wires 34 and 35 are attached to the flanges of electrodes 32 and 33, respectively. The boundary where each of the electrodes 32, 33 meets with the adjoining surface is spaced from the opposite electrode at a distance which is at least equal to the creeping distance which in turn is greater than the thickness T of the portion of PTC layer 31 where upper and lower electrodes 32, 33 overlap.

Figure 17:
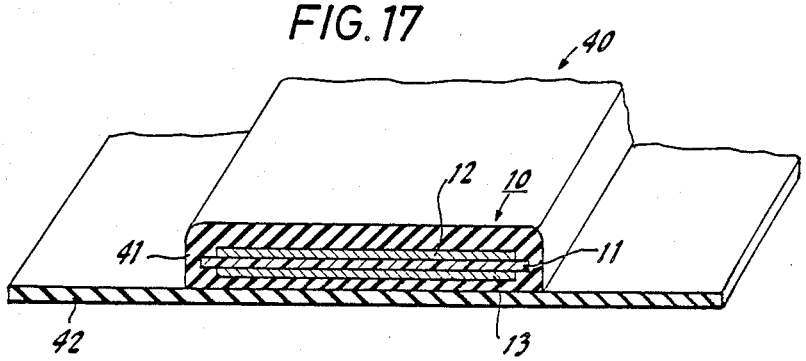
FIGS. 17 to 21 are perspective views of various embodiments each having an insulative enclosure.

FIG. 17 shows an insulated heating article 40 which comprises the metal-backed heating strip 10 enclosed with a polyvinylchloride layer 41 and cemented to a base 42 having a larger flexural rigidity than layer 41 to enable it to be worked with ease. Article 40 is attached to an object to be heated with the base 42 being in contact with the object. Enclosure 41 serves to confine heat generated by PTC layer 11 and base 42 serves as an energy diffusion surface to uniformly transfer the confined energy to the object being heated.

Figure 18:
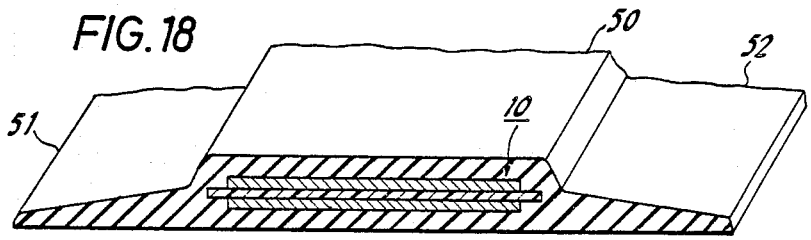

The heating article 10 may be enclosed in a mold as shown at 50 in FIG. 18. The mold 50 is shaped to form a pair of flanges 51, 52 which are outwardly tapered in thickness. The mode presents a sufficient contact surface with an object to be heated for efficient heat diffusion and transfer.

Figure 19:
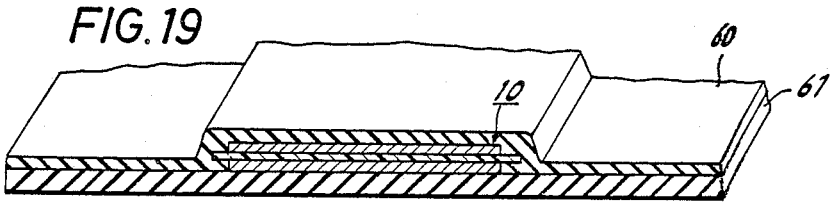

In FIG. 19, metal-backed strip 10 is sandwiched between resin films 60 and 61. Film 61 has a thickness 1.5 times greater than the thickness of film 60 and a flexural rigidity three times greater than that of film 60. Films 60 and 61 extend laterally and are cemented together to form a thin laminated structure. High rigidity inorganic material such as mica can also be used for film 61.

Figure 20:
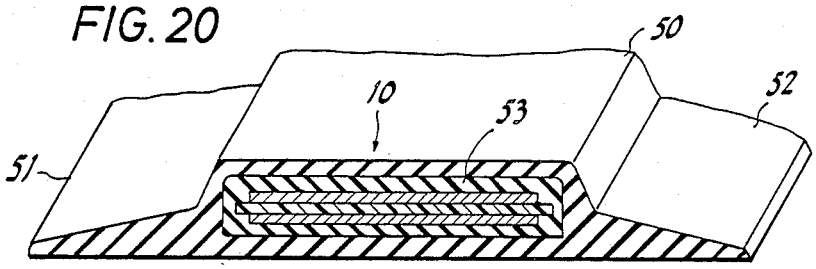
Figure 21:
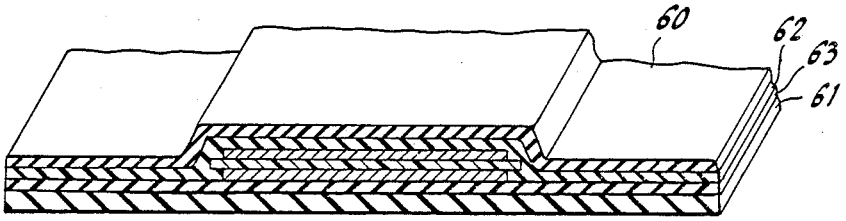

An embodiment shown in FIG. 20 is similar to the FIG. 18 embodiment with the exception that it includes a thermally fused layer 53 interposed between the metal-backed strip 10 and the surrounding polyvinylchloride mold 50. Fusable layer 53 is formed of a resin having a lower melting point than mold 50 to serve as a cushion for working the molded heating article. This layer 53 also functions as a filler to fill in any interstices which might exist to reduce the thermal resistance. Such fusable material can also be employed as shown in FIG. 21 as a modification of FIG. 19 by forming fused films 62 and 63 between layers 60 and 61. This structure permits the films 60 and 61 to be formed by an extrusion process.

For space heating application each of the previous embodiments is used as many times as desired and arranged side by side on a large metal sheet.

Figure 22:
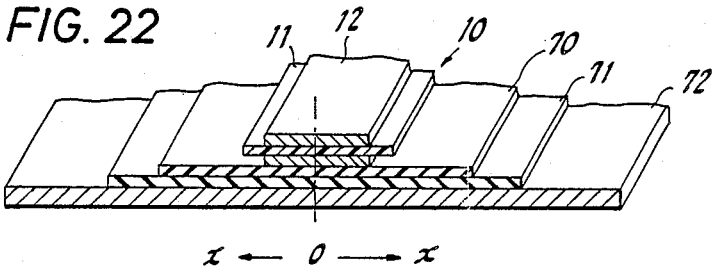
FIG. 22 is a perspective view of a preferred embodiment having a heat diffusion layer.
Figure 23:
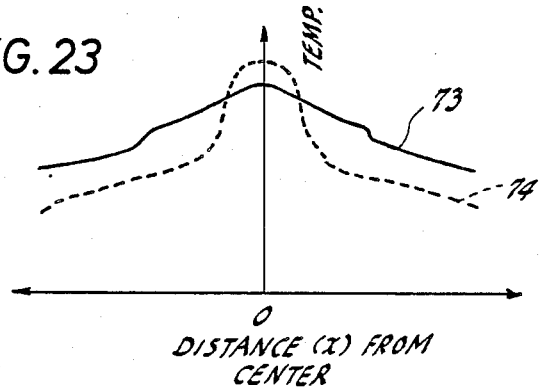
FIG. 23 is a graphic illustration associated with the embodiment of FIG. 22.

In FIG. 22, metal-backed PTC strip 10 is in contact with a highly conductive layer 70 having a larger surface than strip 10. Layer 70 is formed of a material such as aluminum, copper or iron to provide a heat diffusion function and is cemented to an insulating layer 71 having low thermal conductivity and a larger area than layer 70. Insulating plate 71 is secured to a heat radiation metal sheet 72 having a larger area than insulating plate 71. Heat generated by the PTC article 10 diffuses in all directions by conductive layer 70 and is conducted through insulating member 71 to the radiating surface 72. By the interposition of insulating layer 71, thermal energy is conducted to the radiating surface 72 with a minimum of loss. As indicated by a solid-line curve 73 in FIG. 23, the provision of the conductive layer 70 serves to distribute thermal energy uniformly over the surface of the radiating sheet 72 as favorably compared with the heat distribution which is obtained without the heat diffusion layer 70 as indicated by a broken-line curve 74. More specifically, the temperature is raised by 3° C. on the average although there is a decrease at the center by 2° C. As a result, the heat radiating surface 72 is heated to a temperature approaching the self-regulating point of the PTC layer 11. A space heater having a large heat dissipation area can be accomplished by this embodiment.

Figure 24:
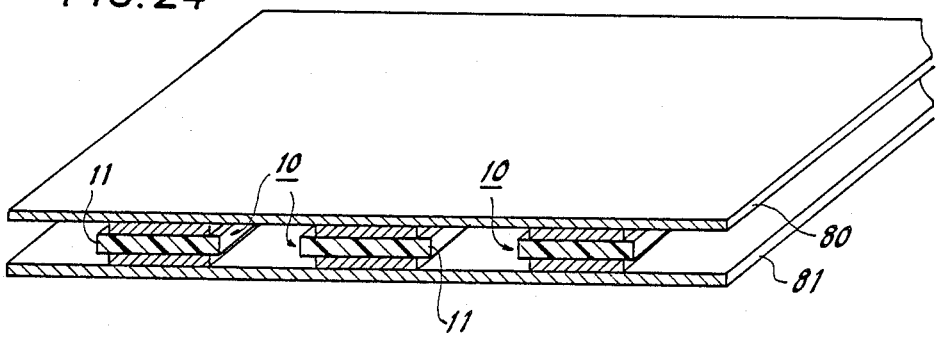
FIGS. 24 to 26 are perspective views of panel heaters incorporating the present invention.
Figure 25:
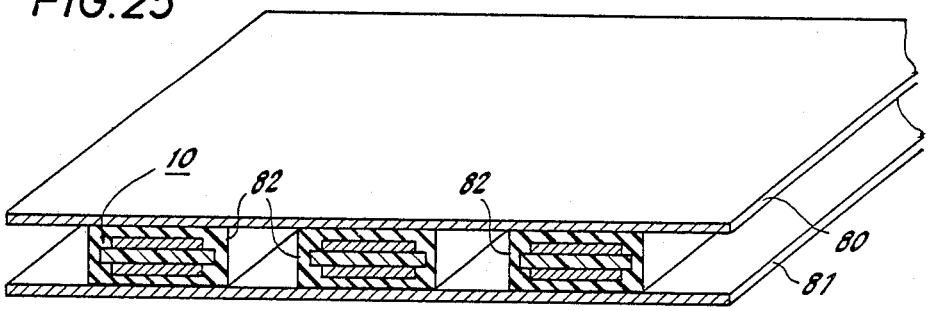

FIG. 24 is an illustration of a space heater employing a plurality of metal-backed heating articles 10 each having a1-mm thick PTC layer. Articles 10 are arranged side by side between opposed aluminum heat radiation metal sheets 80 and 81. An interesting feature of this embodiment is that temperature difference measured across the opposite surfaces of the PTC layer 11 was one-fourth of the value which was obtained when one of the metal sheets 80, 81 was dispensed with. This means that for an apparatus having a pair of opposed heat radiating surfaces, the amount of thermal energy withdrawn from the PTC elements is four times greater than is possible with an apparatus having a single heat radiation surface. To provide insulation between radiation surfaces 80 and 81, each of the metal-backed articles 10 is enclosed by an insulating layer 82 as shown in FIG. 25. This insulation is preferred to coating the radiating surfaces with an insulating film.

Figure 26:
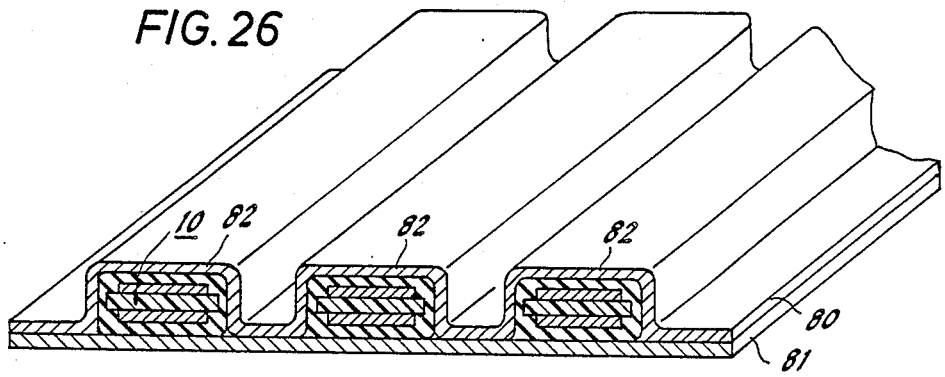

The embodiment of FIG. 25 is modified as shown in FIG. 26 in which the radiating surface 80 is formed into a corrugated shape to make contact with the opposite radiating surface 81. With this corrugation, any temperature difference which might develop between surfaces 80 and 81 can be uniformly distributed between them.

The foregoing description shows preferred embodiments of the present invention. Various modifications are apparent to those skilled in the art without departing from the scope of the present invention which is only limited by the appended claims. Therefore, the embodiments shown and described are only illustrative, not restrictive.

What is claimed is:

1. A self-regulating heating article comprising:

a first elongate layer comprising a crystalline polymeric composition of high crystallinity and conductive particles dispersed in said polymeric composition to exhibit a positive temeperature coefficient of resistance, a thickness of said first layer being 3 millimeters or less;

a pair of second conductive elongate layers adapted for connection to a power supply, said second layers being secured one on each surface of said first layer to develop a potential in the direction of thickness of the first layer, said second layers having a creeping distance therebetween along peripheral edges, said creeping distance being greater than the thickness of said first layer such that said first layer has a portion protruding outwardly beyond a perpendicular dropped from a peripheral edge of one of said second layers on the other of said second layers, said outwardly protruding portion being provided along the entire peripheral edge of one of said second layers where the other of said second layers is present;

an insulative layer enclosing said first layer and second layers; and a flexible layer attached to said insulative layer, said flexible layer having a transverse dimension greater than a transverse dimension of said first layer.

2. A self-regulating heating article comprising:

a first elongate layer comprising a crystalline polymeric composition of high crystallinity and conductive particles dispersed in said polymeric composition to exhibit a positive temperature coefficient of resistance, a thickness of said first layer being 3 millimeters or less;

a pair of second conductive elongate layers adapted for connection to a power supply, said second layers being secured one on each surface of said first layer to develop a potential in the direction of thickness of the first layer, said second layers having a creeping distance therebetween along peripheral edges, said creeping distance being greater than the thickness of said first layer such that said first layer has a portion protruding outwardly beyond a perpendicular dropped from a peripheral edge of one of said second layers on the other of said second layers. said outwardly protruding portion being provided along the entire peripheral edge of one of said second layers where the other of said second layers is present; and an insulative layer enclosing said first layer and second layers, said insulating layer having a pair of longitudinally extending flanges one on each side of the enclosed first and second layers.

3. A self-regulating heating article comprising:

a first elongate layer comprising a crystalline polymeric composition of high crystallinity and conductive particles dispersed in said polymeric composition to exhibit a positive temperature coefficient of resistance, a thickness of said first layer being 3 millimeters or less;

a pair of second conductive elongate layers adapted for connection to a power supply, said second layers being secured one on each surface of said first layer to develop a potential in the direction of thickness of the first layer, said second layers having a creeping distance therebetween along peripheral edges, said creeping distance being greater than the thickness of said first layer such that said first layer has a portion protuding outwardly beyond a perpendicular dropped from a peripheral edge of one of said second layers on the other of said second layers, said outwardly protruding portion being provided along the entire peripheral edge of one of said second layers where the other of said second layers is present;

a pair of third, thermally fused layers between which said second layers are interposed, said thermally fused layers having a transverse dimension greater a transverse dimension of said second layers;

a fourth layer on one of said third layers; and a fifth layer attached to the other of said third layers, the fifth layer having a rigidity greater than the rigidity of said fourth layer.

* * * * *